US012338043B2

(12) United States Patent
Yun

(10) Patent No.: US 12,338,043 B2
(45) Date of Patent: Jun. 24, 2025

(54) CUP LID CAPABLE OF KEEPING BEVERAGE CONCENTRATION CONSTANT

(71) Applicant: MANSANG KOREA CO., LTD., Seoul (KR)

(72) Inventor: Mansang Yun, Gwacheon-si (KR)

(73) Assignee: MANSANG KOREA CO., LTD., Seoul (KR)

( * ) Notice: Subject to any disclaimer, the term of this patent is extended or adjusted under 35 U.S.C. 154(b) by 0 days.

(21) Appl. No.: 18/279,347

(22) PCT Filed: Nov. 5, 2021

(86) PCT No.: PCT/KR2021/016011

§ 371 (c)(1),
(2) Date: Aug. 29, 2023

(87) PCT Pub. No.: WO2023/080282

PCT Pub. Date: May 11, 2023

(65) Prior Publication Data

US 2024/0270458 A1 Aug. 15, 2024

(51) Int. Cl.

| | |
|---|---|
| ***B65D 51/28*** | (2006.01) |
| ***A47G 19/22*** | (2006.01) |
| ***B65D 43/02*** | (2006.01) |

(52) U.S. Cl.

CPC ..... *B65D 51/2857* (2013.01); *A47G 19/22* (2013.01); *B65D 43/02* (2013.01)

(58) Field of Classification Search

CPC ..... A47G 19/22; A47J 31/40; A47J 31/407; B65D 43/02; B65D 43/0212; B65D 51/24; B65D 51/28; B65D 51/2814; B65D 51/2857; B65D 85/72

USPC ..... 220/212, 521, 709; 206/5, 219

See application file for complete search history.

(56) References Cited

U.S. PATENT DOCUMENTS

| | | | | |
|---|---|---|---|---|
| 8,453,833 | B2 * | 6/2013 | Porter | B65D 51/2828 222/521 |
| 2010/0044377 | A1 | 2/2010 | Porter | |
| 2015/0336723 | A1 * | 11/2015 | Koennecke | B65D 51/2835 206/222 |
| 2021/0048326 | A1 * | 2/2021 | Tonn | G01F 11/006 |

FOREIGN PATENT DOCUMENTS

| | | | |
|---|---|---|---|
| JP | 2006-347623 | A | 12/2006 |
| KR | 20-0473241 | Y1 | 6/2014 |
| KR | 20-0477940 | Y1 | 8/2015 |
| KR | 10-2018-0010089 | A | 1/2018 |
| KR | 10-2324274 | B1 | 11/2021 |

* cited by examiner

*Primary Examiner* — Nathan J Jenness
*Assistant Examiner* — Madison L Poos
(74) *Attorney, Agent, or Firm* — Maschoff Brennan

(57) ABSTRACT

A cup lid of a beverage cup for holding a beverage, according to the present invention, comprises: a body portion which can be combined with a cup so as to cover the upper portion of the beverage cup; and a receptor portion which is formed to face at least a partial surface of the body portion at the lower side of the body portion and has at least a portion of the end thereof connected to the body portion to form a space for accommodating a liquid therein, the receptor portion including an inlet for injecting liquid at the upper end, and one or more leak holes in the lower end, through which the liquid can leak due to gravity.

9 Claims, 5 Drawing Sheets

CUP LID CAPABLE OF KEEPING BEVERAGE CONCENTRATION CONSTANT

TECHNICAL FIELD

The present disclosure relates to a functional disposable cup lid. More specifically, the present disclosure relates to a cup lid capable of keeping a concentration of beverage such as iced coffee constant.

BACKGROUND ART

In general, when iced coffee or the like is put in a disposable cup, a general cup lid 100 as shown in FIG. 1 is used.

The conventional disposable cup lid 100 as shown in FIG. 1 generally is a plastic disposable cup lid of a transparent color, white, or black, and is fixed to a cup via a fixing protrusion at a bottom thereof, and has a hemispherical shape or a flat shape.

In general, a hemispherical transparent cup lid is used when cold beverage such as iced coffee is contained in the cup. A flat white or black disposable cup lid is used when hot beverage is contained in the cup. Further, like the cup lid in FIG. 1, it is common that the cup lid has a hole in a center thereof through a straw may be inserted.

The iced coffee is usually produced by inputting ice, a small amount of water, and strong espresso coffee into a cup. In this case, an amount of water is small initially, so that the coffee becomes very thick, and as time goes by, the ice melts to become water, and thus the concentration of the coffee slowly becomes softer. In this case, the first time a user drinks coffee, the user will drink a very strong coffee, and gradually, will drink a light coffee. When the user drinks the coffee slowly, the user may drink only watery coffee at the end.

DISCLOSURE

Technical Problem

The present disclosure aims to solve all of the above problems.

The present disclosure aims to provide a cup lid capable of keeping a concentration of ice beverage constant.

In addition, the present disclosure aims to provide a cup lid capable of displaying a specific logo or creating a unique shape by including a beverage concentrate in the cup lid.

In addition, the present disclosure aims to provide a cup lid capable of adjusting an amount of leakage of the beverage concentrate in view of a drinking time of the beverage, and maintaining the concentration to indicate a remaining amount and a drink remaining time of the beverage.

Technical Solution

According to one embodiment of the present disclosure, a cup lid for a beverage cup capable of containing a beverage therein includes a body coupled to the beverage cup so as to cover a top of the beverage cup; and a receiving portion disposed under the body and facing the at least a partial surface of the body, wherein at least a portion of an end of the receiving portion is connected to the body to form a space therebetween capable of containing coffee concentrate therein, wherein an injection hole through which the coffee concentrate is input into the space is formed in an upper end of the receiving portion, wherein one or more leak holes through which the coffee concentrate leaks into the cup under gravity are formed in an lower end of the receiving portion.

Advantageous Effects

When the cup lid according to the present disclosure is used, a first high-concentration concentrate is contained in the cup while a second high-concentration concentrate is contained in the cup lid, and then the second high-concentration concentrate slowly flows into the cup. Thus, as the ice inside the cup melts, the user may drink the beverage at a constant concentration as the high-concentration concentrate contained in the cup lid is added to the cup slowly.

In addition, when the cup lid according to the present disclosure is used, a logo of a specific brand or a beautiful pattern may be displayed on the outside of the cup lid when the beverage concentrate is contained, thereby increasing advertising effects or aesthetics.

In addition, when the cup lid according to the present disclosure is used, the user may know the remaining time or remaining amount until the entirety of the remaining concentrate is leaked from the start of drinking the beverage. Thus, the person who drinks the iced coffee may figure out a time duration for which he/she may drink the coffee at a constant concentration, and the remaining time until an entirety of the liquid flows out through the leak hole out of the receiving portion into the coffee cup. Thus, he/she may drink the coffee at the constant concentration leisurely.

BEST MODE

Figure 1:
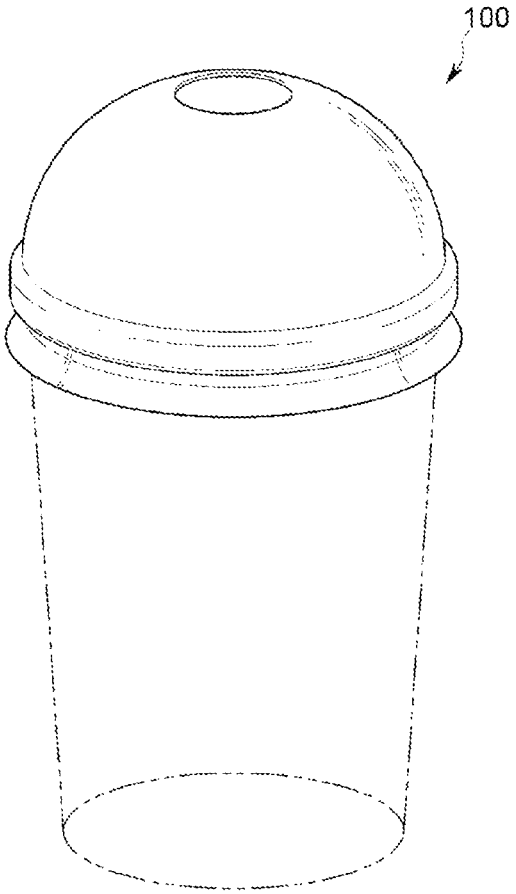
FIG. 1 shows a typical conventional cup lid.

In order to achieve the purpose of the present disclosure as described above and to realize the characteristic effects of the present disclosure to be described later, a characteristic configuration of the present disclosure is as follows.

According to one embodiment of the present disclosure, a cup lid for a beverage cup capable of containing a beverage therein includes a body coupled to the beverage cup so as to cover a top of the beverage cup; and a receiving portion disposed under the body and facing the at least a partial surface of the body, wherein at least a portion of an end of the receiving portion is connected to the body to form a space therebetween capable of containing coffee concentrate therein, wherein an injection hole through which the coffee concentrate is input into the space is formed in an upper end of the receiving portion, wherein one or more leak holes through which the coffee concentrate leaks into the cup under gravity are formed in an lower end of the receiving portion.

In one embodiment, the receiving portion is composed of an upper surface as at least a partial surface of the body, and a lower surface facing the upper surface, wherein the injection hole through which the coffee concentrate is input into the space of the receiving portion is formed in one area of the upper surface of the receiving portion or at least a portion of an area where the upper surface and the lower surface are bonded to each other.

Preferably, a portion of the body as the upper surface of the receiving portion protrudes from a remaining portion thereof, wherein a body hole through which a straw is inserted into the cup is formed in one area of the body.

In another embodiment, the body is formed in a hemispherical shape, and a body hole through which a straw is inserted into the cup is formed at a center of the body, wherein the receiving portion is composed of the upper surface as at least a partial surface of the body, and the lower surface facing the upper surface, wherein the lower surface and the upper surface of the receiving portion are spaced from each other in at least a partial area around the body hole to form the injection hole through which the coffee concentrate is injected into the space of the receiving portion.

Preferably, the cup lid is made of a plastic material.

Preferably, each leak hole includes: a leak hole film having a size corresponding to a size of each leak hole and at least partially coupled to the lower surface so as to block the leak hole; and a leak hole boundary portion formed between the lower surface and the leak hole film and having a thickness smaller than a thickness of each of the lower surface and the leak hole film.

Preferably, each leak hole further includes a connection portion formed between the lower surface and the leak hole film so as to connect the lower surface and the leak hole film to each other in at least partial area.

More preferably, the leak hole includes a plurality of leak holes having different diameters.

In one embodiment, the receiving portion extends in a spiral manner from the body hole positioned at a center of the body to an outer edge of the body, wherein the injection hole is formed at a beginning position of the spiral extension, and the leak hole is formed at an end position of the spiral extension.

In one embodiment, the receiving portion includes, in at least a portion of the upper surface, a concave-convex pattern to display a specific logo.

In another embodiment, the receiving portion further includes an indicator indicating a rough remaining time or remaining amount until an entirety coffee concentrate flows through the leak hole out of the space into the cup.

Mode

For a detailed description of the present disclosure to be described later, reference is made to accompanying drawings illustrating specific embodiments in which the present disclosure may be implemented as an example. These embodiments are described in sufficient detail to enable those skilled in the art to practice the present disclosure. It should be understood that the various embodiments of the present disclosure are different from each other but need not be exclusive of each other. For example, specific shapes, structures, and characteristics as described herein with respect to one embodiment may be implemented in another embodiment without departing from the spirit and scope the of present disclosure. Furthermore, it should be understood that the locations or arrangements of individual components in each disclosed embodiment may be changed without departing from the spirit and scope of the present disclosure. Accordingly, the detailed description set forth below is not intended to be taken in a limiting sense, and the scope of the present disclosure, if properly described, is limited only by the appended claims, together with all scopes equivalent to those claimed by those claims. Like reference numbers in the drawings indicate the same or similar function throughout the various aspects.

Hereinafter, preferred embodiments of the present disclosure will be described in detail with reference to the accompanying drawings so that those skilled in the art may easily carry out the present disclosure.

Figure 2:
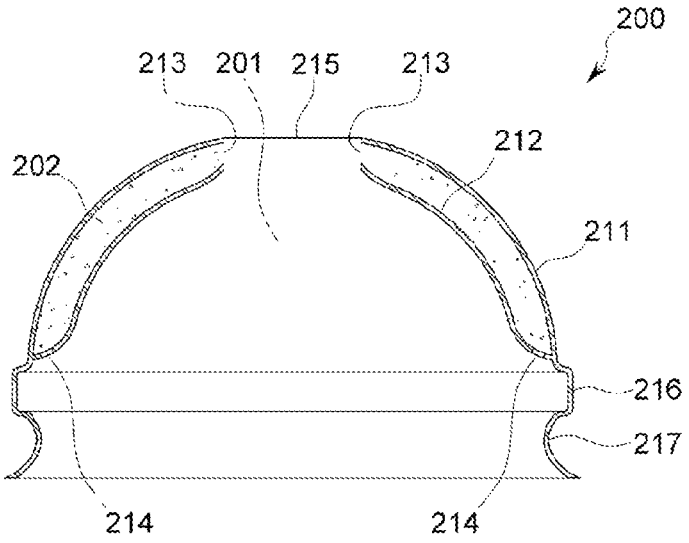
FIG. 2 shows a cross-sectional view of a cup lid according to an embodiment of the present disclosure.

FIG. 2 shows a cross-sectional view of a cup lid according to an embodiment of the present disclosure.

Referring to FIG. 2, a cup lid 200 according to one embodiment of the present disclosure includes a body 201 that may be coupled to a beverage cup so as to cover a top of the beverage cup, and a receiving portion 202 disposed under the body 210 so as to face at least a partial surface (an upper surface 211) of the body 201, wherein and a portion of an end of the receiving portion 202 is connected to the body 201 to define a space to receive a liquid therein, wherein a injection hole 213 for inputting liquid into the space is formed in a top of the receiving portion 202, and one or more leak holes 214 are formed in a lower end of the receiving portion 202, wherein liquid may leak into the cup through the leak holes under gravity. The cup lid 200 may be made of a transparent plastic material or may be made of a plastic material of a color. When the cup lid is not disposable, the cup lid may be made of metal or ceramic.

In one example, the receiving portion 202 has at least the partial surface of the surface of the body 201 as the upper surface 211 of the receiving portion 202, and has a lower surface 212 facing the upper surface 211 such that one liquid receiving space is defined therebetween.

In addition, the injection hole 213 of the receiving portion 202 is formed in a portion of the upper surface or a portion of an area where the upper and lower surfaces meet each other such that the liquid such as coffee concentrate injected into the space of the receiving portion.

In addition, the body 201 may have a body hole 215 through which the user drinks the beverage or a straw may be inserted into the cup, a rim 216 protruding outwardly and disposed at a lower end of the cup lid 200, and a fixed portion 217 that may be coupled to an upper edge of the cup and may be disposed under the rim 216.

Referring again to FIG. 2, the cup lid 200 according to an embodiment of the present disclosure is characterized in that the receiving portion 202 that may contain the coffee concentrate is disposed under the body 201. The receiving portion 202 may be formed in an entirety of an area under the body 201 or may be formed in a portion of an area under the body 201. When the receiving portion 202 is formed in the entirety of the area under the body 201, the receiving portion 202 may be formed in a donut shape around the body hole 215. When the receiving portion 202 is formed only in the portion of the area under the body 201, the receiving portion 202 may be formed in a rectangular or oval shape or may be formed into various shapes of patterns as desired by a manufacturer of the cup lid.

The receiving portion 202 is formed by connecting the upper surface 211 as the at least a portion of the surface of the body 201 and the lower surface 212 facing the upper surface 211 to each other. In addition, the upper surface 211 and the lower surface 212 may be connected to each other in an entire area, or may not be connected to each other but be spaced from each other to form the injection hole 213 or the leaking hole 214. When the upper surface 211 and the lower surface 212 are connected to each other in the entire area, it may be preferable that the injection hole 213 and the leak hole 214 be formed in the upper surface 211 and the lower surface 212, respectively.

In one example, at the upper end of the receiving portion 202, as described above, the injection hole 213 for injecting liquid into the space may be formed. The injection hole 213 may be formed under the body hole 215, or may be formed as an independent hole in one area of the upper surface 211, independent of the body hole 215.

When the injection hole 213 is formed under the body hole 215, the upper surface 211 and the lower surface 212 may not be connected to each other and may be absent in an area under the body hole 215. Thus, an opening may be formed in the area under the body hole. Thus, Espresso coffee concentrate may be injected through this injection hole 213 into the space.

In addition, the leak holes 214 may include preferably holes of different sizes so that different types of liquids such as coffee concentrate contained in the receiving portion 202 may flow down at different flow rates. In this regard, before the coffee concentrate is put into the receiving portion 202, all the leak holes 214 are blocked. Then, after the coffee concentrate is put into the receiving portion 202, selected one among the leak holes may be opened for use. To this end, each leak hole 214 may include a leak hole film at least partially coupled to the lower surface and having a size corresponding to that of the leak hole, and a leak hole boundary portion formed between the lower surface and the leak hole film and having a thickness smaller than that of each of the leak hole film and the lower surface.

Figure 3:
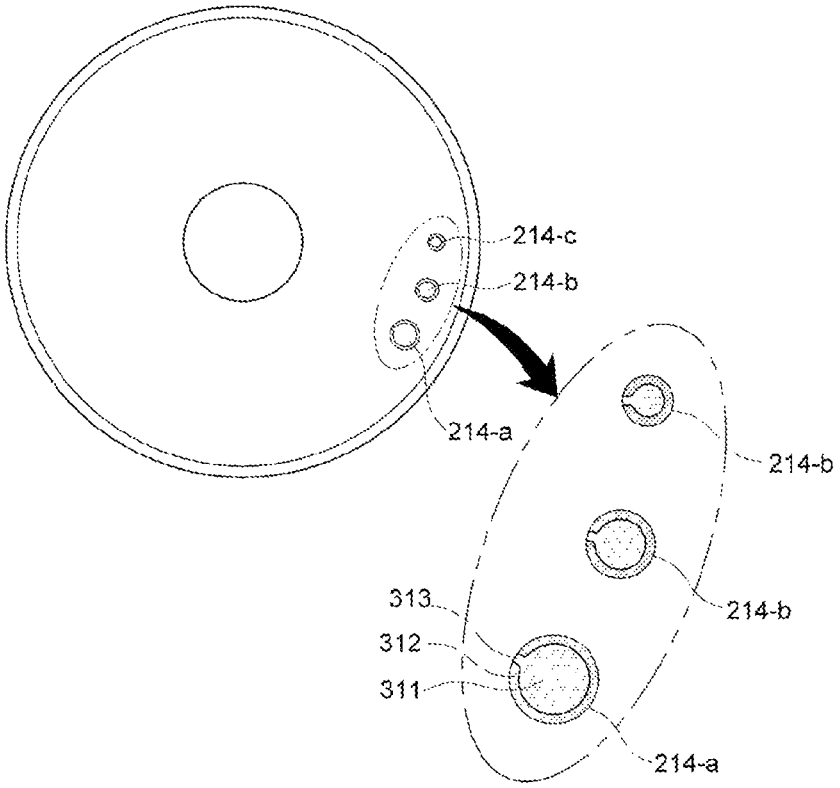
FIG. 3 shows a shape of a leak hole according to an embodiment of the present disclosure.

FIG. 3 shows a shape of a leak hole according to an embodiment of the present disclosure.

Referring to FIG. 3, the leak holes 214 include leak holes 214_*a*, 214_*b*, and 214_*c* of different sizes. Each leak hole is preferably blocked during product manufacturing and sale. Thus, the leak hole is composed of a leak hole film 311 and a leak boundary portion 312. Each leak hole film 311 is manufactured in a size and shape corresponding to a size and a shape of each leak hole, and is made of the same material as that of the lower surface 212 and has the same thickness as that of the lower surface 212. However, it is preferable that the leak hole boundary portion 312 is formed to have a small thickness so that the leak hole film 311 may be easily pierced with an iron core or the like. In addition, the leak hole film 311 is preferably connected to the lower surface 212 via a connection portion 313 to prevent the leak hole film 311 from falling into the cup and being mixed with the beverage when the leak hole film 311 is removed from the leak hole.

Referring to FIG. 2 and FIG. 3, a method of using the cup lid 200 according to the present disclosure is described as follows.

First of all, when serving a beverage mixed with ice, such as iced americano, ice, a small amount of water, and espresso coffee are input into a cup. When the iced coffee is served in this way, the coffee will be too strong at first and too light over time. Therefore, in accordance with the present disclosure, the espresso coffee is additionally injected into the receiving portion 202 of the cup lid 200. That is, when using the cup lid 200 according to the present disclosure, the espresso coffee initially put into the cup is divided into two portions. Then, one portion is input into the cup while the other portion is input into the receiving portion 202. Then, according to the coffee drinking time, the leak hole film of one of the plurality of leak holes 214 may be opened so that the espresso coffee contained in the receiving portion 202 falls into the cup, Then, as the coffee drinking time passes and thus the ice melts, the concentration of the coffee in the cup may be maintained constant due to the added espresso coffee thereto.

Figure 4:
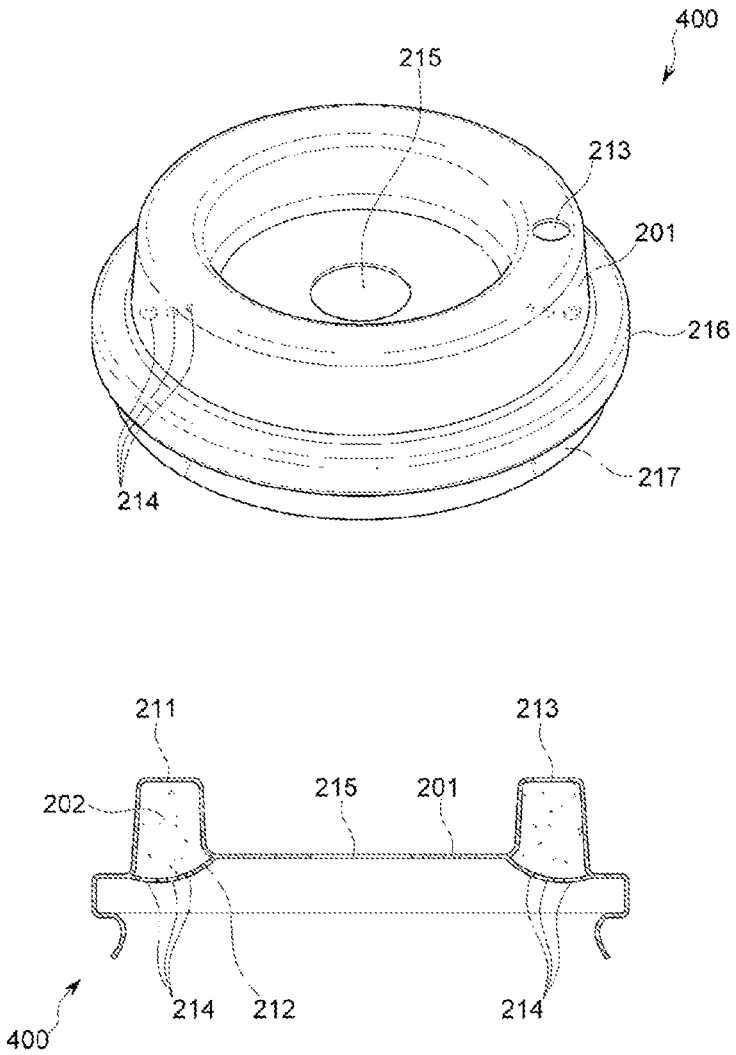
FIG. 4 shows a cup lid according to another embodiment of the present disclosure.

FIG. 4 shows a cup lid according to another embodiment of the present disclosure.

Referring to FIG. 4, a cup lid 400 according to another embodiment of the present disclosure is basically the same as the cup lid 200 of FIG. 2, except for only the shape of the upper surface 201. The upper surface of the cup lid 400 in FIG. 4 is basically flat rather than hemispherical, while only an edge portion of the cup lid 400 in FIG. 4 is convex. In this case, the receiving portion 202 has the upper surface 211 as an edge surface of the cup lid 400, and the lower surface 212 disposed thereunder. Thus, the receiving portion 202 may be formed in a donut shape along the edge of the cup lid 400. The injection hole 213 of the receiving portion 202 is formed at a portion of an upper end of the edge of the cup lid 400, and the body hole 215 is formed in an area other than the upper surface 212 of the receiving portion 202. In this regard, it is preferable that a portion of the upper surface 211 of the body 201 that is shared as the upper surface of the receiving portion 202 protrudes upwardly beyond a remaining portion thereof.

Figure 5:
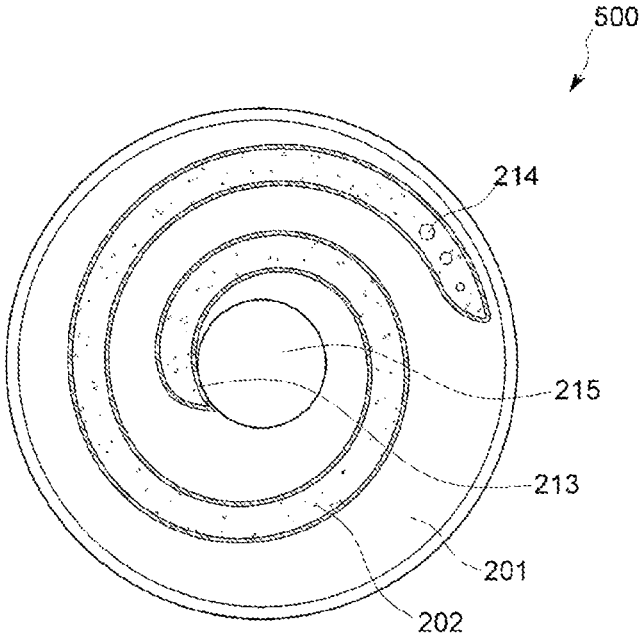
FIG. 5 shows a cup lid according to still another embodiment of the present disclosure.

FIG. 5 shows a cup lid according to still another embodiment of the present disclosure.

Referring to FIG. 5, in the cup lid 500 according to another embodiment of the present disclosure, the receiving portion 202 extends from the body hole 215 in a spiral manner outwardly to an outer edge of the body. In this regard, the injection hole 213 may be formed at the beginning position of the spiral extension, or may be formed adjacent to the body hole 215, and the leak hole 214 may be formed at an end position of the spiral extension.

Thus, not only the remaining amount of liquid contained in the receiving portion 202 such as the coffee concentrate may be visually easily identified, but also a visually beautiful shape may be produced by the liquid contained in the receiving portion.

Figure 6:
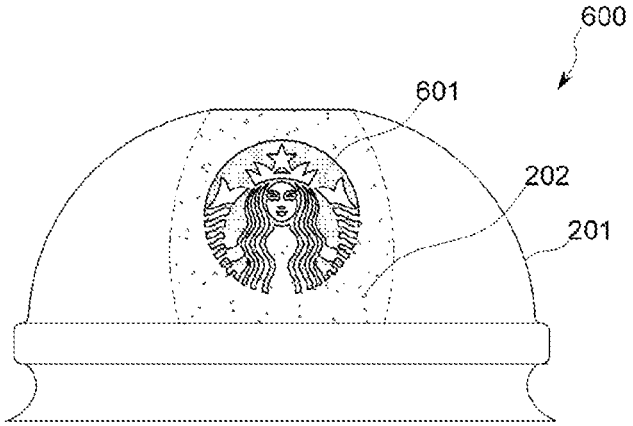
FIG. 6 shows a cup lid according to still yet another embodiment of the present disclosure.

FIG. 6 shows a cup lid according to still yet another embodiment of the present disclosure.

Referring to FIG. 6, at least a portion of the upper surface 211 of the receiving portion 202 of a cup lid 600 according to another embodiment of the present disclosure includes a concave-convex pattern 601 to display a specific logo.

In this case, the liquid contained in the receiving portion 202, for example, espresso coffee, is not transparent. Thus, when the espresso coffee is contained in the receiving portion 202, a logo such as a coffee brand may appear clearly, thereby maximizing the advertising effect.

Figure 7:
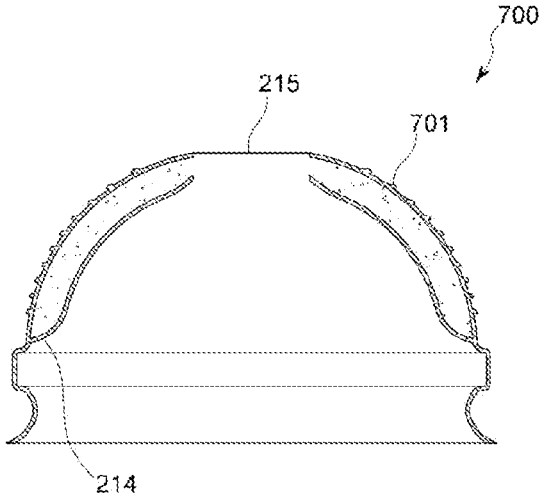
FIG. 7 shows a cup lid according to still yet another embodiment of the present disclosure.

FIG. 7 shows a cup lid according to still yet another embodiment of the present disclosure.

Referring to FIG. 7, a cup lid 700 according to another embodiment of the present disclosure further includes an indicator 701 on the upper surface 211 of the receiving portion indicating a remaining amount of the liquid contained in the receiving portion or a rough remaining time until an entirety of the liquid flows out through the leak hole.

For example, the indicator 701 may be displayed in a manner based on the size of the leak hole 214, and may indicate an approximate remaining time until an entirety of the liquid flows out through the leak hole. Furthermore, the indicator 701 may be displayed as a percentage of the remaining liquid to give an approximate indication of how much the liquid is left.

Thus, a person who drinks the iced coffee may figure out a time duration for which he/she may drink the coffee at a constant concentration, and the remaining time until an entirety of the liquid flows out through the leak hole out of the receiving portion into the coffee cup. Thus, he/she may drink the coffee at the constant concentration leisurely.

The present disclosure has been described above based on specific details such as specific components and the limited embodiments and drawings. However, those are only provided to help a more general understanding of the present disclosure, and the present disclosure is not limited to the above embodiments. Those with ordinary knowledge in the technical field to which the present disclosure belongs may make various modifications and variations to these descriptions.

Therefore, the spirit of the present disclosure should not be limited to the above-described embodiments. Not only the claims to be described later, but also equivalents thereto, or equivalent modifications thereto are within the scope of the spirit of the present disclosure.

INDUSTRIAL APPLICABILITY

The cup lid which can keep the beverage concentration constant may be applied to various cups that may contain coffee and tea.

The invention claimed is:

1. A cup lid for a beverage cup capable of containing a beverage therein, the cup lid comprising:

a body configured to couple to the beverage cup so as to cover a top of the beverage cup; and a receiving portion disposed under the body and facing at least a partial surface of the body, wherein at least a portion of an end of the receiving portion is connected to the body to form a space therebetween capable of containing coffee concentrate therein, wherein an injection hole through which the coffee concentrate is input into the space is formed in an upper end of the receiving portion, wherein one or more leak holes through which the coffee concentrate leaks into the cup under gravity are formed in an lower end of the receiving portion, wherein the receiving portion is composed of an upper surface as at least a partial surface of the body, and a lower surface facing the upper surface, wherein the injection hole through which the coffee concentrate is input into the space of the receiving portion is formed in one area of the upper surface of the receiving portion or at least a portion of an area where the upper surface and the lower surface are bonded to each other, wherein the coffee concentrate leaks through the leak hole into the beverage cup drop by drop at a predetermined time interval, wherein the receiving portion extends in a spiral manner from a body hole positioned at a center of the body to an outer edge of the body, wherein the injection hole is formed at a beginning position of a spiral extension, and the leak hole is formed at an end position of the spiral extension.

2. The cup lid of claim 1, wherein a portion of the body as the upper surface of the receiving portion protrudes from a remaining portion thereof, wherein the body hole through which a straw is inserted into the cup is formed in one area of the body.

3. The cup lid of claim 1, wherein the body is formed in a hemispherical shape, and the body hole through which a straw is inserted into the cup is formed at a center of the body, wherein the lower surface and the upper surface of the receiving portion are spaced from each other in at least a partial area around the body hole to form the injection hole through which the coffee concentrate is injected into the space of the receiving portion.

4. The cup lid of claim 1, wherein the cup lid is made of a plastic material.

5. The cup lid of claim 1, wherein each leak hole includes:

a leak hole film having a size corresponding to a size of each leak hole and at least partially coupled to the lower surface so as to block the leak hole; and a leak hole boundary portion formed between the lower surface and the leak hole film and having a thickness smaller than a thickness of each of the lower surface and the leak hole film.

6. The cup lid of claim 5, wherein each leak hole further includes a connection portion formed between the lower surface and the leak hole film so as to connect the lower surface and the leak hole film to each other in at least partial area.

7. The cup lid of claim 1, wherein the one or more leak holes includes a plurality of leak holes having different diameters.

8. The cup lid of claim 1, wherein the receiving portion includes, in at least a portion of the upper surface, a concave-convex pattern to display a specific logo.

9. The cup lid of claim 1, wherein the receiving portion further includes an indicator indicating a rough remaining time or remaining amount until an entirety of the coffee concentrate flows through the leak hole out of the space into the cup.

* * * * *